US011583889B2

(12) United States Patent
Houlbrook et al.

(10) Patent No.: US 11,583,889 B2
(45) Date of Patent: Feb. 21, 2023

(54) APPARATUS AND A METHOD FOR THE APPLICATION OF RESIN ALONG ONE OR MORE CREASE LINES

(71) Applicant: Supercrease Limited, Leeds (GB)

(72) Inventors: Kenneth Houlbrook, Leeds (GB); Shaun Carter, Leeds (GB)

(73) Assignee: Supercrease Limited, Stourton (GB)

( * ) Notice: Subject to any disclaimer, the term of this patent is extended or adjusted under 35 U.S.C. 154(b) by 399 days.

(21) Appl. No.: 16/737,096

(22) Filed: Jan. 8, 2020

(65) Prior Publication Data

US 2020/0215567 A1 Jul. 9, 2020

(30) Foreign Application Priority Data

Jan. 8, 2019 (GB) ..... 1900257

(51) Int. Cl.

| | |
|---|---|
| ***B05C 17/005*** | (2006.01) |
| ***B05C 17/015*** | (2006.01) |
| ***D06B 1/08*** | (2006.01) |
| *B65D 81/32* | (2006.01) |
| *A41D 1/10* | (2006.01) |
| *B01F 101/00* | (2022.01) |

(52) U.S. Cl.

CPC ..... *B05C 17/00553* (2013.01); *B05C 17/015* (2013.01); *D06B 1/08* (2013.01); *A41D 1/10* (2013.01); *B01F 2101/2305* (2022.01); *B05C 17/0052* (2013.01); *B05C 17/00596* (2013.01); *B65D 81/325* (2013.01)

(58) Field of Classification Search

CPC ..... B05C 17/00553; B05C 17/015; B05C 17/00596; B05C 17/0052; A41D 1/10; B01F 2101/2305; B65D 81/325; D06B 1/08

See application file for complete search history.

(56) References Cited

U.S. PATENT DOCUMENTS 4,508,245 A * 4/1985 Houlbrook ..... B05C 17/00503 222/327
4,756,170 A * 7/1988 Gibson ..... A41D 1/10 118/410
4,778,299 A * 10/1988 Coulter ..... B05C 17/015 118/710
6,722,537 B1 * 4/2004 Houlbrook ..... A41D 1/10 222/569

(Continued)

FOREIGN PATENT DOCUMENTS

EP 1185379 A1 3/2002
WO WO 2018220377 A1 12/2018

*Primary Examiner* — Frederick C Nicolas
(74) *Attorney, Agent, or Firm* — GableGotwals

(57) ABSTRACT

An apparatus and method for application of a line of resin along a crease line of a garment for increasing the life of the crease line. The apparatus in one embodiment allows a simultaneous application of lines of resin along respective crease lines of one or more garments to provide an increase in productivity. The apparatus and method allows the operation of a source of a pressurised fluid source used in dispensing of the resin from one or more cartridges held on mounting apparatus to be achieved by an operator's hand which, at the same time, is used to hold gripping portion on the mounting apparatus to move the cartridges and mounting apparatus with respect to the crease line to apply the resin.

14 Claims, 4 Drawing Sheets

(56) References Cited

U.S. PATENT DOCUMENTS

| | | | | |
|---|---|---|---|---|
| 6,929,161 | B2 * | 8/2005 | Houlbrook | B05C 17/00596 222/569 |
| 8,991,651 | B2 * | 3/2015 | Yeh | B05C 17/015 222/326 |
| 10,954,626 | B2 * | 3/2021 | Houlbrook | D06B 11/0073 |
| 11,140,937 | B2 * | 10/2021 | Carter | A41D 27/245 |
| 2013/0186912 | A1 * | 7/2013 | Yeh | B05C 17/00553 222/326 |
| 2021/0007430 | A1 * | 1/2021 | Houlbrook | B05C 17/01 |
| 2021/0145085 | A1 * | 5/2021 | Houlbrook | A41D 1/10 |

* cited by examiner

APPARATUS AND A METHOD FOR THE APPLICATION OF RESIN ALONG ONE OR MORE CREASE LINES

CROSS-REFERENCE TO RELATED APPLICATIONS

This United States Application claims priority to British Application No. GB1900257.5 filed 8 Jan. 2019, which is incorporated by reference herein.

BACKGROUND OF THE INVENTION

The invention to which this application relates is apparatus and a method for the application of one or more lines of resin along respective crease lines in a garment such as, for example, a pair of trousers or another garment in which a crease line is commonly used.

The application of the lines of resin to allow a crease which has been formed in a garment to be retained for a greater period of time and/or number of uses of the garment is well known. The resin serves to strengthen the crease formation and hence retain the visible crease in the garment for a longer period of time. Typically, this service is provided at the time of manufacture so that when the product is sold, and purchased, the crease line is readily apparent thereby enhancing the appearance of the garment. Alternatively, or additionally, the provision of the resin along the crease line, can be part of a service such as a dry laundry service in which the customer typically pays an additional price for the application of the crease line resin once the garment has been dry cleaned, or the use of the resin is provided as a complimentary extra service.

In either use, the market for this service is large and is worldwide. It is found that the most appropriate way to apply the line of resin, is to provide a cartridge which includes a reservoir of the resin in a cavity therein or receives resin from a pump and, at one end of the cartridge, there is provided a nozzle or aperture through which the resin can be moved and, with the cartridge held in location with the crease line on the garment so as to be in contact therewith or at a spaced distance therefrom, the cartridge is moved along the crease line and the resin which is dispensed through the nozzle, is applied along the crease line. When the resin is located in a cavity in the cartridge, the cartridge includes a piston arrangement which is moved along the interior of the cavity so as to move the resin towards the nozzle in a controlled manner, thereby allowing continuous dispensation of the resin as the cartridge is moved along the crease line. The movement of the piston is typically achieved via the application of a pressurised fluid such as air which is introduced at, or adjacent to, the opposing end of the cartridge from the nozzle so that the air moves the piston, and hence resin, towards the nozzle. The air is typically provided via a supply tube from the cartridge to an air pump and, conventionally, the air pump is operated by the person who is controlling the movement of the cartridge via a foot pedal which, when operated, causes the pressurised air to be supplied to the cartridge. While this form of apparatus has been used for many years, the apparatus can be bulky in terms of the provision of the cartridge, the foot pedal or switch control arrangement and the air pump.

One aim of the present invention is to provide apparatus in a form which is easier to operate and has greater ability to be portable and take up less space and thereby allow the same to be used in locations where space is at a premium.

Typically, when the resin is being applied, the garment is located on a stand or table which has a support surface which has a groove formed therealong and the garment is positioned with respect to the support surface such that the crease in the garment lies along the groove and the resin is applied to the surface of the garment which is to lie to the interior i.e. adjacent to a person's skin, when the garment is being worn. It is important that when the resin is applied, the resin lies in the base of the crease and along the same rather than to one side of the base of the crease as, if it is applied on one side or the other, the crease tends to collapse and the final appearance of the same is counterproductive. However, if the resin lies in the base of the crease then the crease can be maintained for a significantly longer period of time in the garment.

Another problem with the conventional approach is that typically a line of resin is applied from a cartridge along one crease line at a time which therefore requires, typically, for a pair of trousers, four crease lines to be applied one after the other to a single garment and when one considers that for each crease line, the garment needs to be repositioned with respect to the support surface and the groove so that the crease line to which the resin is to be applied at that time, is positioned appropriately, then it will be appreciated that the time to apply the resin for each garment, can be relatively long.

The Applicant, in their co-pending application number PCT/GB2018/051482 has appreciated this problem of relatively slow throughput and, as a result, have developed a system which allows at least two cartridges to be provided in relation to a mounting means so that the cartridges are spaced apart and can be used simultaneously to apply first and second lines of resin along first and second crease lines so that the throughput time is halved.

The Applicant has also appreciated the need to improve the operation of the system to allow the resin to be dispensed from the nozzle of the cartridge and in the co-pending application GB1805759.6, they disclose the ability for the control of the pressurised air source to be achieved without the need for the foot pedal or switch control assembly for the air pump. As disclosed in the co-pending applications, the operator can control the pressurised fluid source via a switch which is mounted on the mounting means into which the cartridges are fitted for use so that the operator can control the pressurised fluid source using their hand and typically, the same hand as is being used to grip the mounting means and hence move the cartridge along the crease line.

A further aim of the present invention is to provide an improved method of operation of the pressurised fluid source which allows a simplified operation of the fluid source to be achieved via the operator's hand.

BRIEF SUMMARY OF THE INVENTION

In a first aspect of the invention there is provided apparatus for applying a line of resin material along a crease line of a garment, said apparatus including one or more cartridges having a cavity in which a resin material is provided and which resin is to be dispensed therefrom via a nozzle onto respective crease lines of a garment, said one or more cartridges held in position with respect to the said respective crease lines via a mounting means which includes a gripping portion to be gripped by an operator to allow the movement of the one or more cartridges along the said respective crease lines as the resin is dispensed therefrom and the dispensation of the resin is achieved by selectively introducing a pressurised fluid into the cavity of the one or more cartridges and wherein the supply of the pressurised fluid is controlled by the operator selectively operating a switching means located at the said gripping portion of the said mounting means.

In one embodiment the said gripping portion of the mounting means is gripped by the operator when moving the mounting means and one or more cartridges as a unit with respect to the garment crease line.

In one embodiment the apparatus includes a support surface which includes one or more elongate grooves therealong and into which one or more crease lines of the garment are positioned during the application of the resin thereto.

In one embodiment the switching means is located so as to be operable by movement of at least a portion of the operator's hand when the operator is holding the gripping portion and, when operated, is connected to cause a change in condition of the source of the pressurised fluid to the said one or more cartridges.

In one embodiment the switching means are located at least partially within the mounting means.

In one embodiment a movable part of the switching means is accessible externally of the mounting means so as to be operable by the said portion of the operator's hand to control the said pressurised fluid source.

In one embodiment switching means are provided at a first side of the gripping portion or a second, opposing side of the gripping portion or at both first and second sides of the gripping portion.

In one embodiment the gripping portion is provided in a fixed position with respect to the mounting means and the switching means are at least partially located in the gripping portion and the said movable part is externally accessible via an aperture in the said gripping portion.

In one embodiment, the said gripping portion is movable with respect to the mounting means in order to operate the switching means.

In one embodiment the direction of movement of the gripping portion is substantially perpendicular to the direction of movement of the mounting means along the crease line.

In one embodiment, the movement of the said gripping portion is in a direction which is towards the said garment and a support surface on which the garment is located.

In one embodiment, the support surface includes a groove therealong and into which the crease line is positioned during the application of the resin thereto.

In one embodiment, the said gripping portion is slidably moveable with respect to the mounting means via guide means so that the same, when the movement force is supplied thereto, is only moveable in one direction.

In one embodiment, biasing means are provided so as to bias the said gripping portion to a position at which the supply of the pressurised fluid is closed.

In one embodiment, when the said gripping portion is moved against the biasing means, the switching means and hence pressurised fluid source is turned on and the pressurised fluid is supplied into the cavity of each of the one or more cartridges via supply tubes connected to the respective cartridges so as to move a piston along the cavity towards a dispensing nozzle and as it does so, move the resin positioned between the piston and the dispensing nozzle to be dispensed through the nozzle in a controlled manner.

Typically, when the said switching means is in the on position the pressurised fluid is supplied from an air pump connected to the switching means and to the one or more cartridges.

In one embodiment, the said switching means is an air switch or an electrical switch, and includes a part which is movable between on and off positions by direct contact with the operator's hand or via contact with the gripping portion.

In one embodiment, the mounting means includes location positions for first and second cartridges which are provided at spaced locations.

In one embodiment, the said gripping portion is positioned intermediate the said cartridges and thereby lie substantially centrally of the mounting means on a surface opposing the surface of the mounting means with respect to which the cartridges are located.

In one embodiment, when the gripping portion is movable with respect to the mounting means body, when pressure is applied to move the said gripping portion then the movement force is applied substantially centrally to the mounting means body.

Typically the gripping portion can be held such that the operator's hand can simultaneously control operation of the pressurised fluid source and move the mounting means and the cartridges along the said respective crease lines to apply resin therefrom.

In one embodiment, the said cartridges are located on first and second support assemblies and the support assemblies are provided to locate the cartridges at spaced locations along the longitudinal axis of said respective cartridge so that the cartridges are located and retained in a substantially parallel arrangement.

In one embodiment, the cartridges are moveable within a limited range of movement in a lateral direction to the longitudinal axis of the cartridges so as to allow any variation in the crease line and/or groove in the support surface, to be taken into account as the cartridges are moved along the same and thereby enhance the ability of the resin which is applied, to be applied to the base of the crease.

In a further aspect of the invention there is provided a method for the application of a line of resin along a crease line of a garment, said method including the steps of: locating the crease line of the garment along a groove on a support surface. moving a cartridge containing a quantity of resin along the crease line and dispensing resin from the cartridge as movement occurs and a mounting means is provided which includes a gripping portion to be gripped by an operator as the cartridge is moved along the said crease line and wherein the dispensation of the resin is achieved by selectively introducing a pressurised fluid into the cavity and the operator controlling the supply of the pressurised fluid by selectively operating a switching means located at the said gripping portion of the said mounting means.

In one embodiment two cartridges are mounted side by side on the mounting means and allow the simultaneous dispensing of resin therefrom along respective crease lines.

Typically, the source of the pressurised fluid is a common source for both cartridges and is an air pump.

In one embodiment, the operation of the said portion of the mounting means, is achieved by the operator using their hand to move the portion against the biasing means to an open position.

In one embodiment, the biasing means is provided as an integral part of a switch and the movement of the said portion moves the switch to an on or open position and hence operates the pressurised fluid source.

BRIEF DESCRIPTION OF THE DRAWINGS

Specific embodiments of the invention are now described with reference to the accompanying drawings wherein.

DETAILED DESCRIPTION OF THE INVENTION

Figure 1:
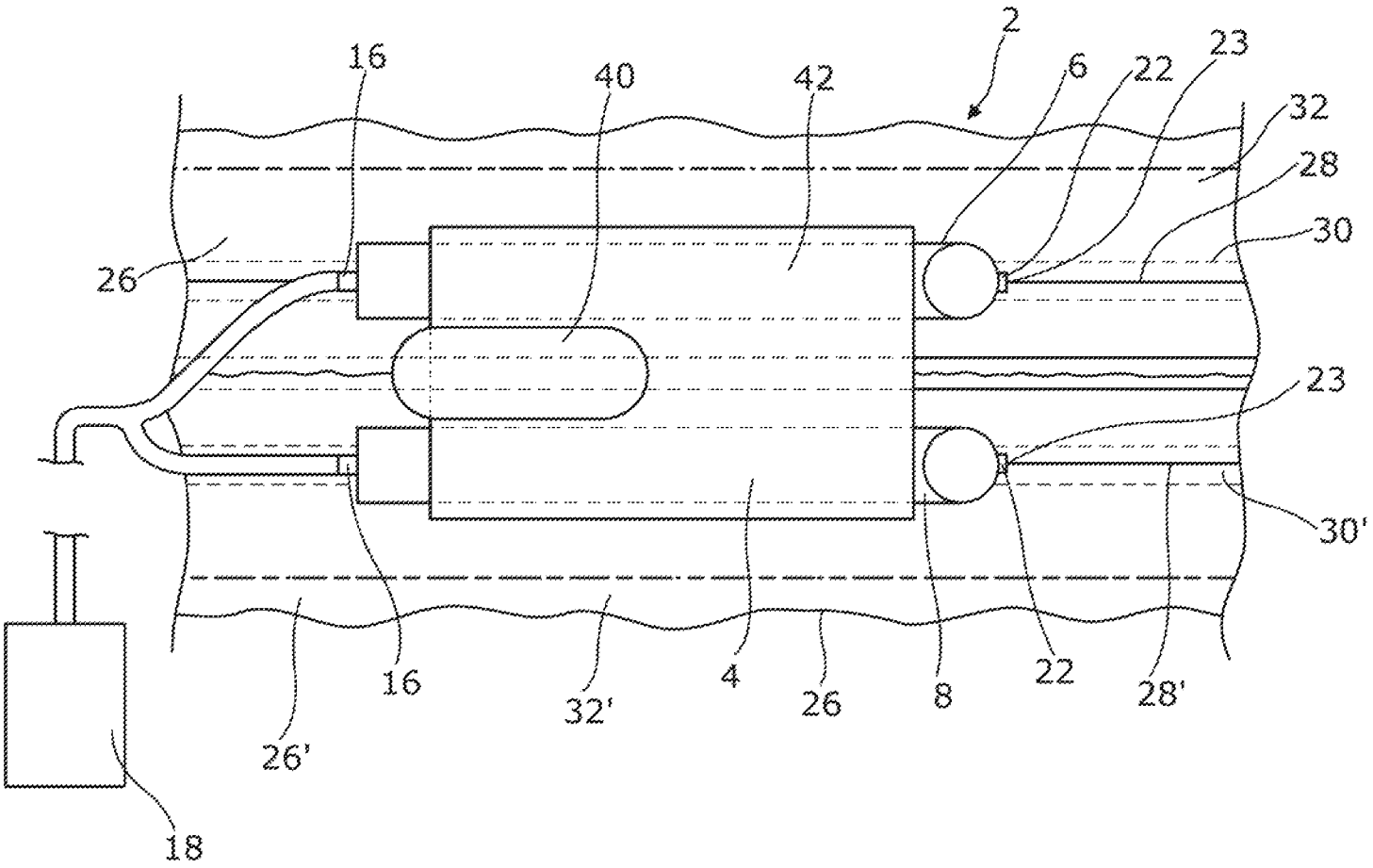
FIG. 1 illustrates a plan in a schematic manner one embodiment of the invention in which there are provided a first and second cartridges held on a mounting means.

Referring firstly to FIG. 1, there is illustrated apparatus and a method in one embodiment for applying lines of resin to creases of a garment. The apparatus 2, includes a mounting means 4 with which are selectively located in respective support assemblies, first and second cartridges 6,8. The cartridges are selectively connectable to the mounting means so as to allow the replacement of the same when they become empty of the resin material which is provided in a fluid condition within a cavity of the cartridge.

The cartridges can be as defined in the Applicant's patent EP1185379 and typically comprise a body 10 which defines therein a cavity in which a quantity of the fluid resin is located along with a piston. The cartridge, at one end, includes a connection 16 to a pressurised fluid source 18 which typically is an air pump. At or adjacent to the opposing end of the cartridge, there is provided a dispensing assembly including a nozzle 22 which has a channel or port 23 therethrough which connects the cavity of the cartridge with an opening at the tip of the port to allow a quantity of the resin material to flow through the said opening.

The assembly is provided to be used in the application of resin from the respective cartridges 6,8 so that a first line of resin is applied from the first cartridge 6 and a second line of resin is applied from the second cartridge 8 with the lines of resin in parallel and along the base of parallel crease lines 30, 30' in one or more garments 26, such as legs 26,26' of a pair of trousers which are located on one or more support surfaces 32, 32'. The support surfaces have formed therein first and second grooves 28, 28' which are provided at the same spaced apart relationship as are the openings from the respective cartridges when held in the mounting means 4 so that when the creases 30,30' are in location along the respective grooves 28,28' then the lines of resin are applied along the base of the respective creases and subsequently cure and harden to retain the crease line.

Figure 2A:
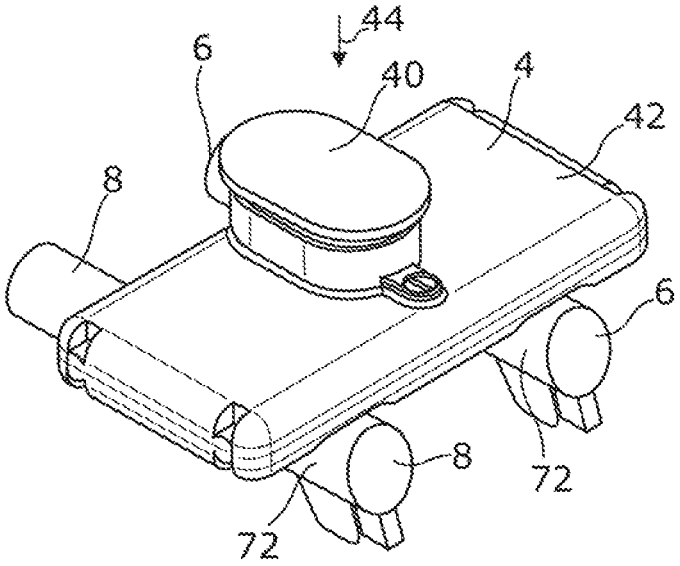
FIGS. 2*a-e* illustrates views of one embodiment of the apparatus in accordance with the invention.
Figure 2B:
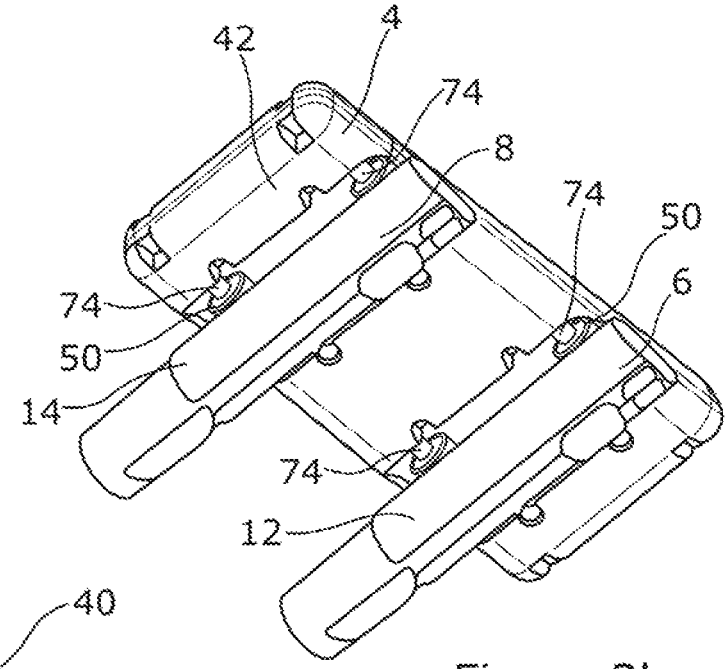
Figure 2C:
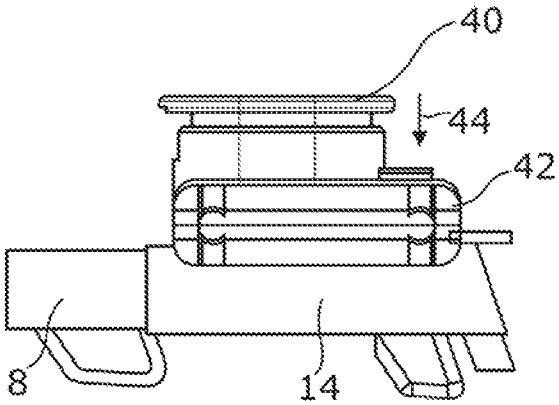
Figure 2D:
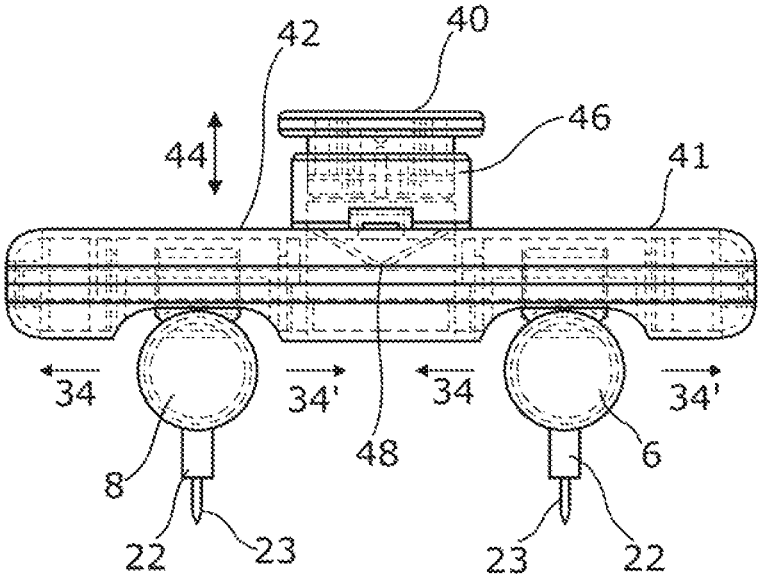
Figure 2E:
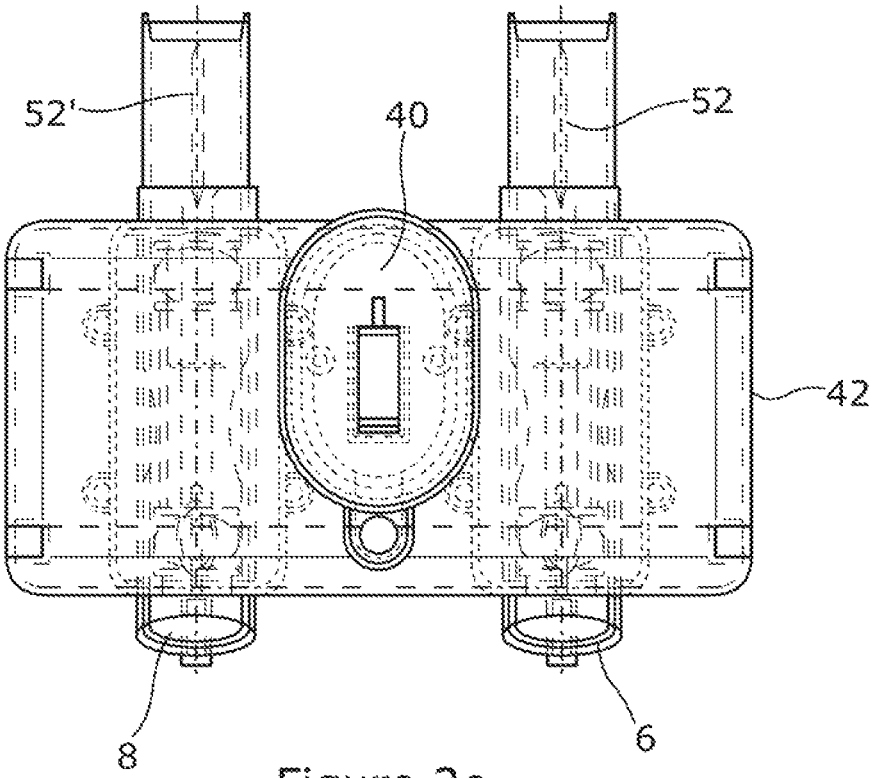

The mounting means 4 can include some resilience as illustrated in FIG. 2*d* in terms of allowing sideways movement of the respective cartridges as indicated by arrows 34,34' with respect to their longitudinal axis 52, 52' so that any deviation in the crease line or groove along which the cartridges are moved, can be taken into account to thereby try to ensure that the line of resin is applied along the bases of the creases when in location along the grooves rather than a sidewall of the crease as this can adversely affect the quality of the resin application.

The resin is moved out of the cartridge cavity through the opening 23 under the influence of the piston located in the cavity and the piston is moved by the provision of the pressurised air into the cavity to one side of the piston, with the resin material being located on the other side of the piston. Thus, the appropriate pressure of the pressurised air source allows the resin to be forced out of the cartridge, and the movement of the cartridge along the crease line allows the resin material to be applied from the opening onto the crease at the required amount and, this can occur simultaneously from both cartridges so as to allow two lines of resin to be applied at the same time.

In the present invention, the operation of the pump 18 to allow the pressurised air to be provided, is achieved by the operator using their hand and, typically the same hand which is used to move the mounting means along the crease lines, by holding a gripping portion 40 located on the body 42 of the mounting means. Thus, the portion 40 is shaped so as to be ergonomically effective when gripped and allow the mounting means 4 to be moved to slide the cartridges along the crease lines. There is a significant advantage in terms of efficiency, comfort and usage of available space, in being able to use the gripping portion 40 to allow the operation of the pressurised fluid source and, at the same time, the movement of the mounting means and dual cartridges.

In accordance with the embodiment shown in FIGS. 2*a-e*, to operate the fluid source 18 the operator holds the gripping portion 40 and applies a force to the same, typically downwardly towards the body 42 of the mounting means 4 as illustrated by arrow 44, and this acts to operate an air or electrical switching means 48 which is located in the mounting means, typically located between the portion 40 and the body 42. The movement of the gripping portion to operate the switching means 48, is typically guided by guide means 46 which allow smooth movement of the portion 40 so that the application of the movement force downwardly on the portion 40 and the movement of the same with respect to the mounting means, downwardly and upwardly, does not adversely affect the position of the gripping portion and hence the mounting means when it is being held to move the mounting means along the crease lines and so does not have any adverse effect on the guidance of the application of the resin onto the garment crease line or lines.

In one embodiment, the switching means 48 includes a body and switch portion which is resiliently biased to a raised position away from the body 40 in which case the switching means is in an off position and the pressurised fluid supply is closed with the pump 18 not operating. The switching means 48 is positioned so that the application of the downward force 44 via the portion 40, acts against the biasing force and moves the switch portion to an on position which in turn sends an operate signal to operate the pump 18 via a connection cable or wirelessly to then allow the pressurised fluid to be provided from the pump to each of the cartridges and it will typically be the case that the same pump is used to supply the pressurised fluid to both cartridges 6,8.

Figure 3A:
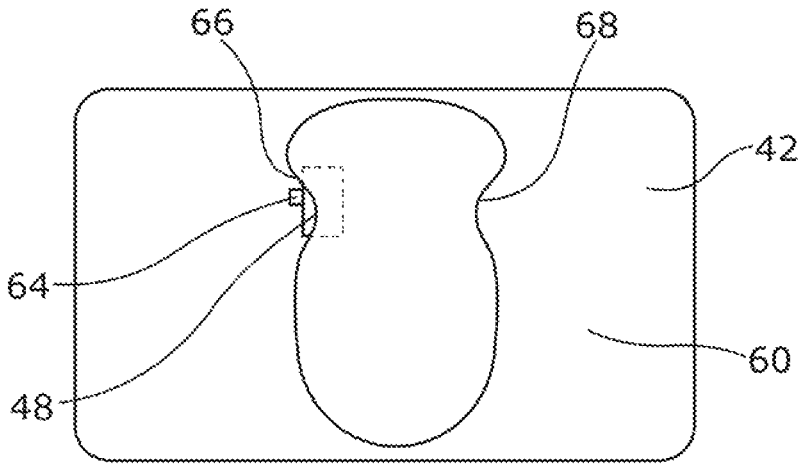
FIGS. 3*a-c* illustrate views of a further embodiment of the apparatus in accordance with the invention.
Figure 3B:
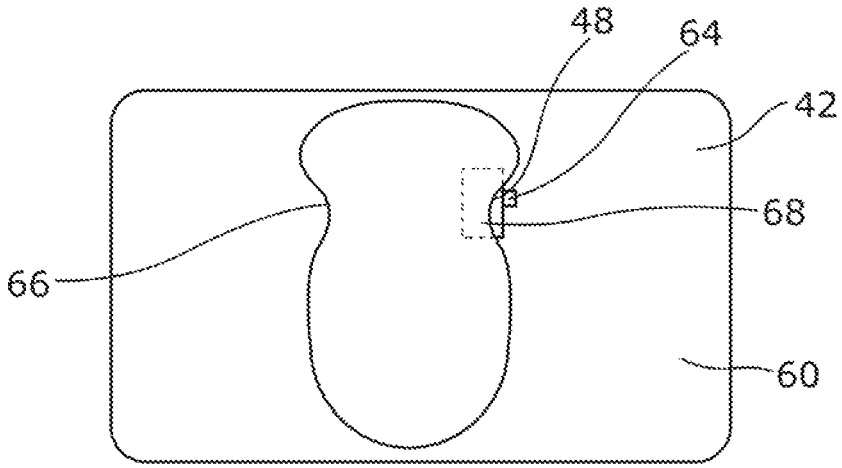
Figure 3C:
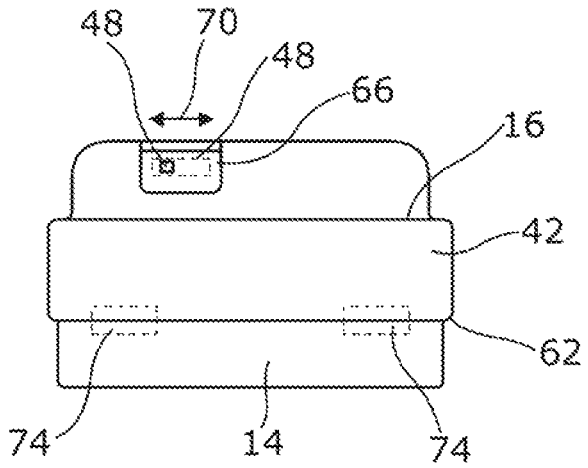

Turning to FIGS. 3*a-c* there is illustrated a further embodiment of mounting means 4 in accordance with the invention. In this embodiment the mounting means again includes a body 42 and a gripping portion 40 on a first upper surface 60 and support assemblies 50 including brackets 12,14 and resilient connectors 74 to the opposing surface 62 of the body 42 and which receive the cartridges therein. In this embodiment the gripping portion 40 is formed as an integral part of the body 42 and is fixed in position with respect thereto. However the operation of the pressurised fluid source in this embodiment is achieved by operating the switch portion 64 of the switching means 48. The switching means 48 are located with respect to the gripping means 40 and body 42 such that the switch portion 64 is accessible externally of the gripping means with the remainder of the switching means 48 located within the gripping portion 42 as shown in broken lines in FIGS. 3*a* and *b*.

Typically the gripping means includes two access apertures 66, 68 and the switching means 48, in the embodiment shown in FIG. 3*a* is located so that the switch portion 64 is accessible through the aperture 66 and in FIG. 3*b* the switching means 48 is located so that the switch portion 64 is accessible through the aperture 68. As it is envisaged that the switch portion will be operated by the operator's thumb when holding the gripping portion 40 to move the mounting means, the ability to select which side of the gripping portion 40 at which the switch portion 64 is located, means that the apparatus can be easily adapted to allow convenient use of the switching means 48 by a right or left handed person when holding the gripping means 40 by sliding the switch portion 64 between on and off positions as indicated by arrows 70 in FIG. 3*c* and hence control the operation of the pump connected thereto.

Typically, each of the said cartridges 6, 8 are located on first and second support assemblies 50 which include a bracket 12,14 and resilient connectors 74 which are provided at spaced locations along the longitudinal axis 52, 52' of said cartridge so that the cartridges 6,8 are located and retained in a substantially parallel arrangement as illustrated in FIGS. 1 and 2*a-e*.

There is therefore provided an improved form of cartridge mounting means and also an improved manner of control of operation of the application of the resin material from the cartridges held by the mounting means onto the crease lines of the garment. The improved control system for the supply of pressurised air also means that the bulkiness of the apparatus is also significantly reduced thereby allowing the apparatus to be used in relatively confined spaces whilst ensuring that the supply of the resin material along the crease lines is effectively achieved.

The invention claimed is:

1. Apparatus for applying a line of resin material along a crease line of a garment, said apparatus comprising:

one or more cartridges having a cavity in which a resin material is provided and which resin is to be dispensed therefrom via a nozzle onto the crease lines, said one or more cartridges held in position with respect to the respective crease lines via a mounting means which includes a gripping portion to be gripped by an operator to allow movement of the one or more cartridges along respective crease lines as the resin is dispensed therefrom, and dispensation of the resin is achieved by selectively introducing a pressurised fluid into the cavity of the one or more cartridges, and a supply of the pressurised fluid is controlled by the operator selectively operating a switching means located at the gripping portion of the mounting means by movement of at least a portion of the operator's hand when the operator is holding the gripping portion and, when operated, is connected to cause a change in condition of a source of the pressurised fluid to the one or more cartridges;

the gripping portion being slidably moveable with respect to a body of the mounting means via guide means to operate the switching means, the sliding movement being in a direction perpendicular to the direction of movement of the mounting means to apply resin from the one or more cartridges along the crease line; and wherein biasing means are provided to bias the gripping portion to a position so that the switching means are in a position to control the source of the pressured fluid such that the source is in an off condition and no pressured fluid is supplied to the one or more cartridges.

2. Apparatus according to claim 1 wherein the gripping portion of the mounting means is gripped by the operator when moving the mounting means and one or more cartridges as a unit with respect to the garment crease line.

3. Apparatus according to claim 1 wherein the apparatus includes a support surface which includes one or more elongate grooves therealong and into which one or more crease lines of the garment are positioned during application of the resin thereto.

4. Apparatus according to claim 1 wherein the switching means are located at least partially within the mounting means.

5. Apparatus according to claim 4 wherein a movable part of the switching means is accessible externally of the mounting means so as to be operable by the portion of the operator's hand to control the pressurised fluid source.

6. Apparatus according to claim 5 wherein the switching means are provided at a first side of the gripping portion or a second, opposing side of the gripping portion or at both first and second sides of the gripping portion.

7. Apparatus according to claim 5 wherein the gripping portion is provided in a fixed position with respect to a body of the mounting means and the switching means are at least partially located in the gripping portion and the movable part is externally accessible via an aperture in the gripping portion.

8. Apparatus according to claim 1 wherein when the switching means is operated to move the pressurised fluid source to an on position pressurised fluid is supplied into the one or more cartridge's cavity so as to move the piston along the cavity towards a dispensing nozzle and move the resin located between the piston and the dispensing nozzle towards the dispensing nozzle so as to be dispensed from the cartridge.

9. Apparatus according to claim 8 wherein the pressurised fluid source is an air pump connected to the one or more cartridges via air supply tubes.

10. Apparatus according to claim 1 wherein the switching means is an air or electrical switch.

11. Apparatus according to claim 1 wherein the mounting means includes location positions for first and second cartridges which are provided at spaced locations.

12. Apparatus according to claim 11 wherein the switching means is connected to control the supply of pressurised fluid to both of said cartridges and allow dispensing of resin from both cartridges simultaneously.

13. Apparatus according to claim 11 wherein the gripping portion is positioned intermediate the first and second cartridges and centrally on a surface of the mounting means which opposes a surface with respect to which the cartridges are located via first and second support assemblies which are provided to contact with the respective cartridges at spaced locations along the longitudinal axis of said cartridge so that the cartridges are located and retained in a parallel, spaced arrangement.

14. Apparatus according to claim 13 wherein the first and second cartridges when located in the respective first and second support assemblies are moveable within a limited range of movement in a lateral direction to the longitudinal axis so as to allow variation in the crease line and/or groove in the support surface to be taken into account as the cartridges are moved along the same.

* * * * *